United States Patent [19]

Eldridge et al.

[11] Patent Number: 5,059,989

[45] Date of Patent: Oct. 22, 1991

[54] THERMAL EDGE JET DROP-ON-DEMAND INK JET PRINT HEAD

[75] Inventors: Jerome M. Eldridge, Los Gatos; Gary S. Keller; Francis C. Lee, both of San Jose, all of Calif.; Graham Olive, Vancouver, Canada

[73] Assignee: Lexmark International, Inc., Greenwich, Conn.

[21] Appl. No.: 524,197

[22] Filed: May 16, 1990

[51] Int. Cl.[5] ..... B41J 2/05

[52] U.S. Cl. ..... 346/140 R; 346/76 PH

[58] Field of Search ..... 346/140, 76 PH

[56] References Cited

U.S. PATENT DOCUMENTS

| | | | |
|---|---|---|---|
| 4,520,373 | 5/1985 | Ayata | 346/140 |
| 4,571,599 | 2/1986 | Rezanka | 346/140 |
| 4,611,219 | 9/1986 | Sugitani | 346/140 |
| 4,764,659 | 8/1988 | Minami | 346/76 PH X |
| 4,866,461 | 9/1989 | Piatt | 346/140 |

FOREIGN PATENT DOCUMENTS 208249 10/1985 Japan .

OTHER PUBLICATIONS

Bubble Ink Jet Head; IBM Tech. Disc. Bulletin, vol. 31, No. 10, Mar. 1989, pp. 3–4.

*Primary Examiner*—Joseph W. Hartary

*Attorney, Agent, or Firm*—Otto Schmid, Jr.

[57] ABSTRACT

A thermal drop-on-demand ink jet print head in which conductor electrodes are formed on opposed surfaces of a print head substrate and extend to the edge of the substrate. An array of heater elements is formed on the edge of the substrate in electrical contact with the conductor electrodes. A nozzle plate is mounted with a nozzle aligned with each heater element, and a manifold is positioned to provide ink to the space between the nozzle plate and the edge of the substrate so that a drop of ink can be ejected from the nozzle each time the associated heater element is energized with a data pulse applied to a selected one of the conductor electrodes.

5 Claims, 5 Drawing Sheets

THERMAL EDGE JET DROP-ON-DEMAND INK JET PRINT HEAD

FIELD OF THE INVENTION

This invention relates to an ink jet printing system, and more particularly to a thermal drop-on-demand ink jet printing system.

DESCRIPTION OF THE PRIOR ART

A thermal drop-on-demand ink jet printing system is known in which a heater is selectively energized to form a "bubble" in the adjacent ink. The rapid growth of the bubble causes an ink drop to be ejected from a nearby nozzle. Printing is accomplished by energizing the heater each time a drop is required at that nozzle position to produce the desired printed image.

One embodiment of a thermal drop-on-demand print head ("end shooter") is shown in Shirato et al., U.S. Pat. No. 4,458,256, "Ink Jet Recording Apparatus", issued July 3, 1984; and Hawkins, U.S. Pat. No. 4,774,530, "Ink Jet Printhead", issued Sept. 27, 1988. In this embodiment, the ink drops are ejected at the edge of the print head. The control electrodes and the heater elements are formed on the same surface of the print head substrate, and grooves are formed in a confronting plate to form channels leading to the nozzles at the edge of the substrate. This print head has the advantage of a thin profile so that multiple heads can be stacked together; however, this design has proven to be difficult to obtain the required nozzle quality with high yield.

Another embodiment of a thermal drop-on-demand ink jet print head ("top shooter") is shown in Hay et al., U.S. Pat. 4,590,482, "Nozzle Test Apparatus and Method for Thermal Ink Jet Systems", issued May 20, 1986. In this embodiment, the nozzles are in a direction normal to the heater surface. This print head design has a much shorter channel length and therefore high-frequency operation is possible. However, the electrical fan-out must be produced all on one side of the print head substrate so that the print head is physically large.

The present requirements for ink jet printing systems include color printing and a high print rate. For color printing four colors are usually sufficient so four print heads are required, one for black and one for each of the three primary colors. The "end shooter" has a configuration in which four print heads can be stacked in a compact assembly. However, this design lacks high-frequency operation. On the other hand, the "top shooter" is capable of higher frequency operation, but has a design in which an array of four print heads is physically large and therefore unsuitable to meet the present requirements.

The prior art does not disclose a thermal drop-on-demand print head that has both a high-frequency operation and a design suitable for producing a compact four print head array so that the print head is suitable for meeting the present color printing requirements.

SUMMARY OF THE INVENTION

It is therefore the principal object of this invention to provide a compact thermal drop-on-demand ink jet print head which is capable of high-frequency operation.

In accordance with the invention, the conductor electrodes are formed on a surface of a substrate and extend to the edge of the substrate. An array of heater elements is formed on the edge of the substrate with each heater element being in electrical contact with at least one of the conductor electrodes. A nozzle plate comprising a plurality of nozzles is fixed in a position in which each of the nozzles is spaced from the edge of the substrate and positioned opposite a heater element. A fluid manifold is provided along with a fluid path from the manifold to the space between the heater elements and the nozzle plate so that a drop of ink is ejected from a nozzle each time the associated heater element is energized with a data pulse applied to a selected one of the conductor electrodes.

The placement of the heater elements on the edge of the thin substrate makes possible a short channel length so that high frequency operation results. In addition, the narrow print head configuration allows stacked arrays that are suitable for high resolution color printing and would also be useful for page wide arrays.

DESCRIPTION OF THE PREFERRED EMBODIMENTS

Figure 1:
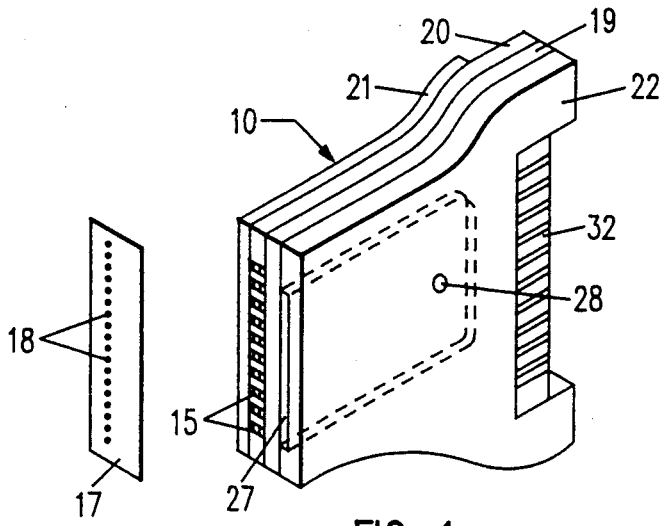
FIG. 1 is a three-dimensional exploded view of a specific embodiment of a thermal drop-on-demand ink jet print head according to the present invention.
Figure 2:
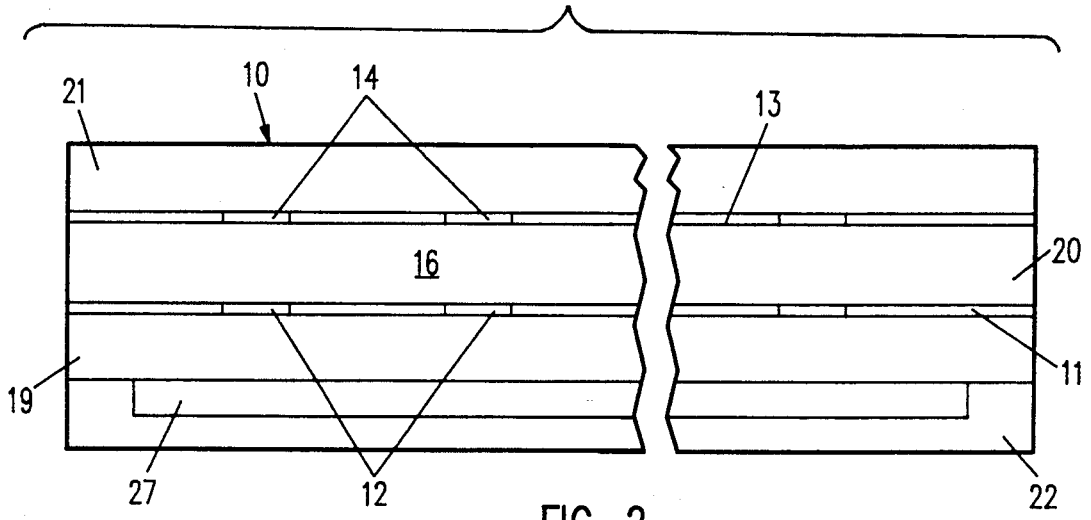
FIG. 2 is a view of the edge of the thermal drop-on-demand ink jet print head of FIG. 1 prior to the deposition of the thin film resistive heater elements.
Figure 7:
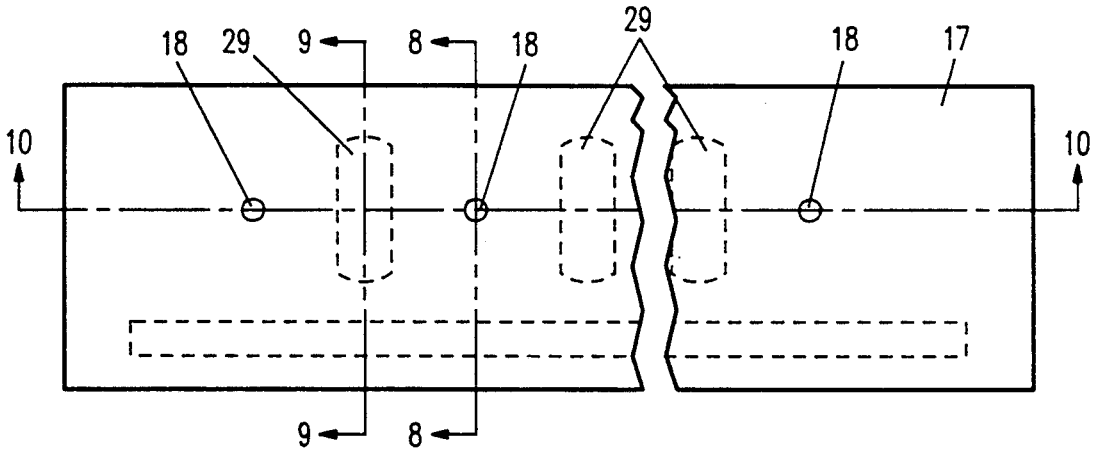
FIG. 7 is a front view of the print head of FIG. 1.

Referring to FIGS. 1 and 2 of the drawings, the thermal drop-on-demand ink jet print head 10, according to the present invention, comprises a suitable substrate 20 upon one surface 11 of which is formed a first array of conductive electrodes 12, and upon a second surface 13 of which is formed a second array of conductive electrodes 14. An array of thin film resistive heater elements 15 is formed on an edge 16 of substrate 20. A nozzle plate 17 is fixed in position adjacent to but spaced from edge 16 of substrate 10, with a nozzle 18 aligned with each of the heater elements 15. An ink supply is provided to supply a marking fluid such as ink to the space between each of the nozzles 18 and heater elements 15.

In operation, a data pulse is supplied to one of the control electrodes 12 to energize the associated resistive heater element 15 to produce a bubble in the ink adjacent to heater element 15. The inertial effects of a controlled bubble motion toward the nozzle forces a drop of ink from the associated nozzle 18.

Substrate 20 may comprise any suitable material such as glass, silicon, or ceramic, for example. The desired conductor electrode patterns for electrode arrays 12 and 14 are fabricated on surfaces 11 and 13 of substrate 20 by suitable deposition and patterning techniques. Thin cover sheets 19 and 21 of an insulating/passivating material are added to protect the conductor layers 12 and 14. Cover sheets 19 and 21 are formed of a material that is well matched for thermal expansion with substrate 20 and are bonded to the substrate by suitable techniques such as epoxy bonding, fusing, or field-assisted bonding, for example. A lapping and polishing operation is then performed on edge 16 to create a flat, smooth surface for deposition of the thin film resistive heater elements 15.

To supply ink flow to the heaters, a third cover plate 22 having a recess 27 and an ink supply opening 28 is bonded on one side of the substrate before the lapping process. Ink supplied to opening 28 is held in recess 27 and is distributed to individual nozzles 18 by means of a flow channel structure built into the nozzle plate 17, as will be described later in greater detail.

Figure 3:
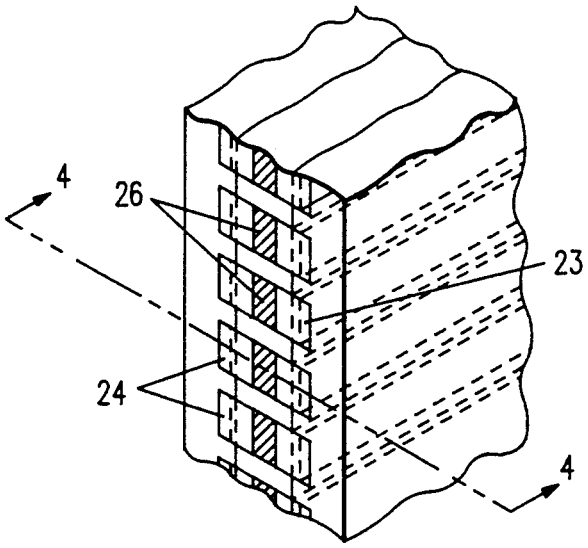
FIG. 3 is a three-dimensional view of a part of the edge of the print head of FIG. 1 after deposition of the thin film resistive heater elements.
Figure 4:
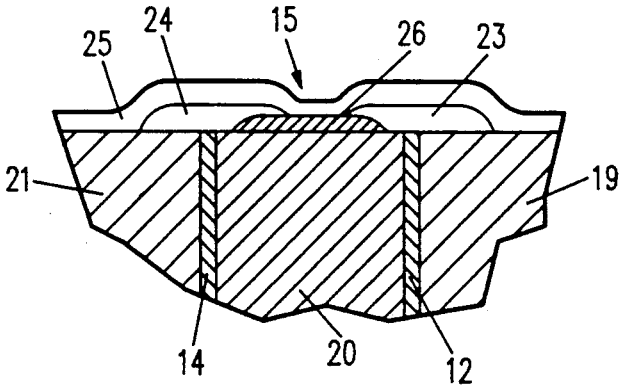
FIG. 4 is a section view taken along lines 4—4 of FIG. 3.

After polishing is completed, a layer of resistive material such as $HfB_2$ is deposited and patterned (FIGS. 3 and 4) to produce an array of spaced areas of resistive heater material 26 with one area of heater element 26 in alignment with each conductive electrode 12 and one conductive electrode 14. Since the substrate 20 thickness at edge 16 is normally at least equal to the length of the heater element and preferably greater than the desired length of heater element 15, an array of short thin film conductor electrodes 23 is added to make electrical contact between one edge of the heater element 15 and the exposed edge of the associated conductive electrode 12. In addition, an array of short thin film conductor electrodes 24 is added to make electrical contact between the other edge of the heater element 15 and the associated conductive electrode 14. The necessary passivation overcoats 25 are provided, and the overcoat 25 is preferably a dual layer of materials such as $Si_3N_4$/Ta or $Si_3N_4$/SiC, for example, as is known in the art.

Figure 5:
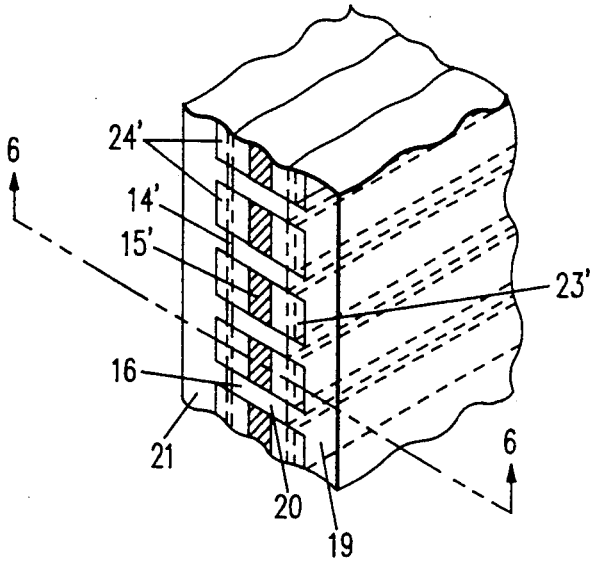
FIG. 5 is a three-dimensional view of a part of the edge of an alternate embodiment of a thermal drop-on-demand ink jet print head.
Figure 6:
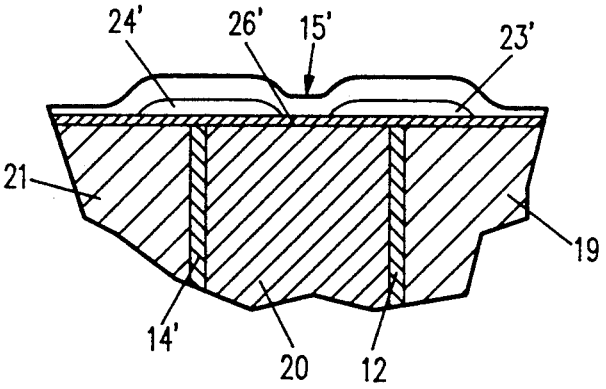
FIG. 6 is a section view taken along lines 6—6 of FIG. 5.

An alternate embodiment of the thermal drop-on-demand ink jet print head is shown in FIGS. 5 and 6 in which the conductive electrode array 12 is produced with discrete electrodes; however, the conductive electrode array 14' is produced with one electrode that is common to a plurality of heater elements 15'. In addition, the heater elements 15' are produced by an array of areas of heater material 26' which extend across the edge 16 of substrate 20, conductive electrode 12, and conductive electrode 14'. In the embodiment shown, conductive electrodes 23' and 24' are deposited over and electrically short a portion of heater material 26' so that the effective area of the heater elements 15' is defined by the unshorted area between conductive electrodes 23' and 24'. Alternatively, conductive electrodes 23' and 24' could be deposited first so that they are under the heater material 26'.

Figure 8:
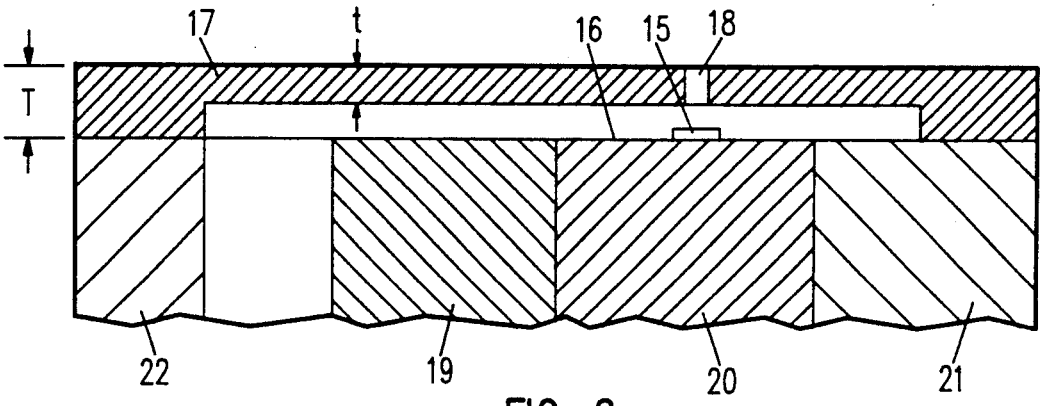
FIG. 8 is a section view taken along lines 8—8 of FIG. 7.
Figure 9:
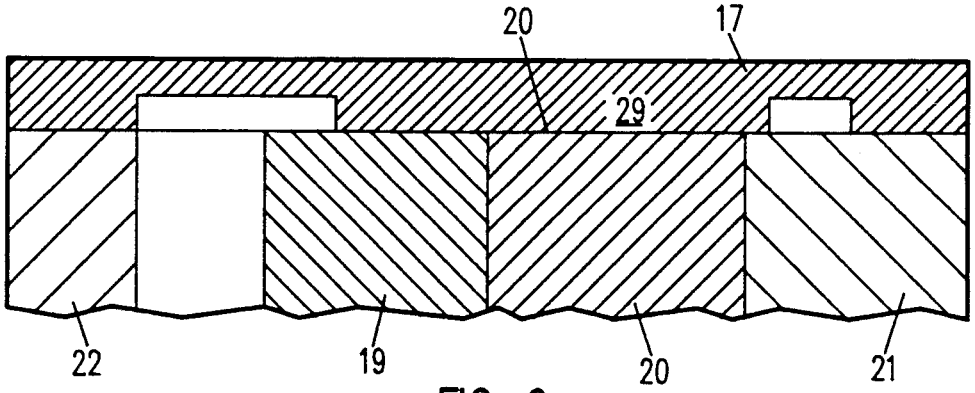
FIG. 9 is a section view taken along lines 9—9 of FIG. 7.
Figure 10:
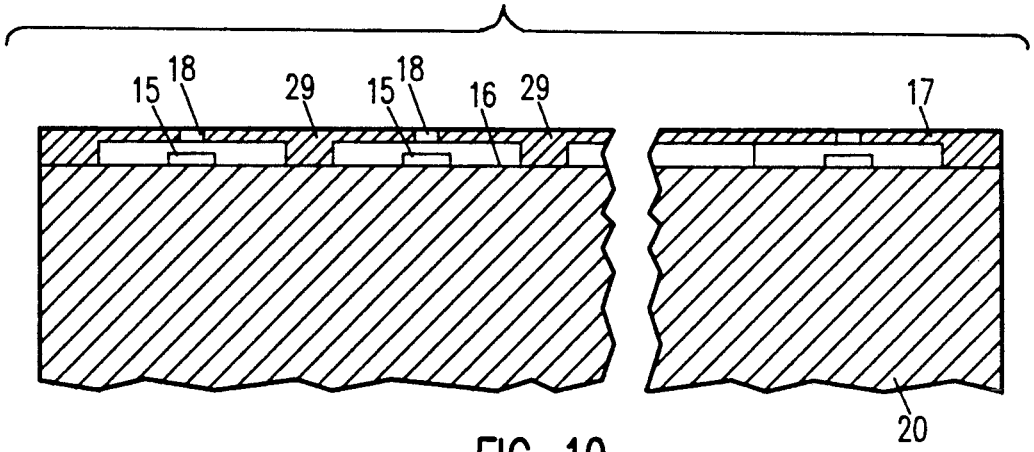
FIG. 10 is a section view taken along lines 10—10 of FIG. 7.

The nozzle plate 17 comprises a plurality of nozzles 18, with each nozzle 18 aligned with one of the resistive heater elements 15. The nozzle plate 17 also has a flow channel structure which is formed within the surface of the nozzle plate 17 which faces the resistive heater elements 15. In the embodiment of the nozzle plate shown in FIGS. 7–10, the nozzle plate 17 has a chosen thickness T which is maintained all around the outer peripheral region of the nozzle plate 17 so that the nozzle plate 17 can be easily bonded to the print head body in a fluid-tight manner and hold the nozzles 18 in a fixed position spaced from the edge 16 of substrate 20. The flow channel structure is provided by forming areas of the nozzle plate 17 in which the nozzle plate thickness is reduced to a smaller thickness t. Wall sections 29 are maintained to the full thickness T, and these wall sections 29 are located between each of the nozzles 18. The wall sections 29 extend over a substantial part of the width of the nozzle plate 17 (FIG. 9), and these wall sections 29 serve to prevent cross-talk between adjacent nozzles 18. Alternatively, it is possible to produce wall sections 29 on the edge of the substrate and have a flat nozzle plate. During operation, when one of the resistive heater elements 15 is energized, a bubble 30 (FIG. 8) is formed and its rapid expansion causes a drop of ink 31 to be ejected from the associated nozzle 18. Due to the presence of wall sections 29, the ink is not substantially perturbed at either of the adjacent nozzles 18.

The print head 10 shown in FIG. 1 has thick film electrodes with very minimal resistance relative to the heater regions 15 so that the electrical loading due to the leads is minimal. In addition, this design provides unencumbered space on surfaces 11 and 12 of substrate 20 for handling electrical fan-out and interconnections to the driver circuits. The print head 10 also has a plug-in edge connector 32.

Figure 11:
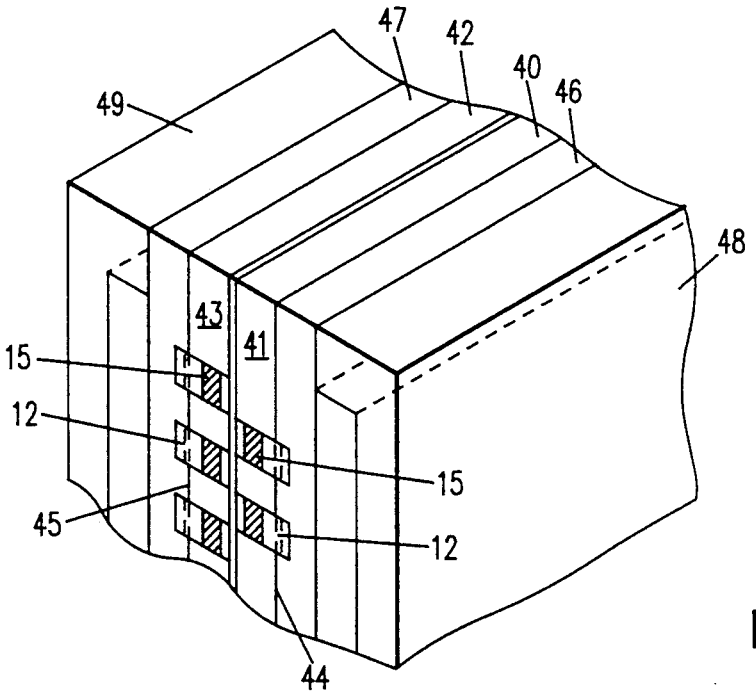
FIG. 11 is an alternate embodiment of the thermal drop-on-demand ink jet print head embodying the present invention.

In some cases, a single row of nozzles may not permit printing at a desired print resolution. In the embodiment shown in FIG. 11, a two-column approach permits a higher resolution to be achieved. This embodiment comprises a first substrate 40 and a second substrate 42 which have a similar structure. The difference in structure relates to the position of the heater elements 15 on the edges 41, 43 of the substrates 40, 42. The heater structures 15 are staggered so that a heater element 15 on substrate 40 is opposite the space between two adjacent heater structures 15 on substrate 42. The two substrates 40, 42 are bonded together with a surface in contact, and this surface is provided with a common electrode on each substrate. On the opposite surfaces 44, 45 of the substrates 40, 42, an array of conductive electrodes 12 is deposited. The print head also comprises cover sheets 46, 47 and ink supply plates 48, 49 which are bonded to the print head in the same fashion as described before. The nozzle plate (not shown) comprises two parallel rows of nozzles with the nozzles in one row staggered with respect to the nozzles in the other row.

Figure 12:
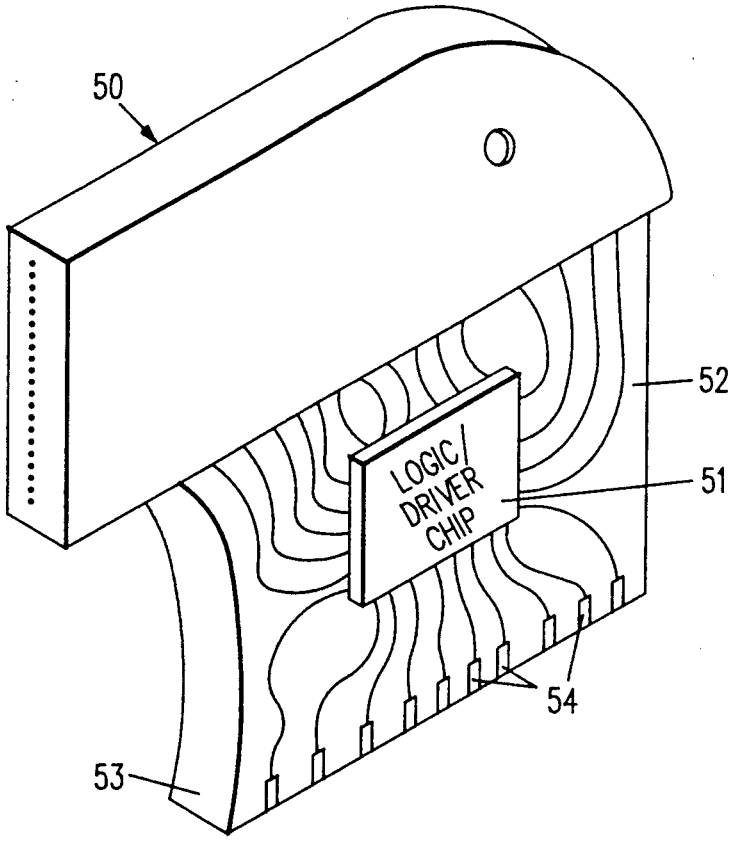
FIG. 12 is a further embodiment of the thermal drop-on-demand ink jet print head embodying the present invention.

An alternate embodiment for a thermal drop-on-demand ink jet print head 50 is shown in FIG. 12. In this embodiment, a logic/driver integrated circuit chip 51 is mounted on one surface 52 of the print head substrate 53. In this case, electronic multiplexing can be utilized to reduce the number of output contact pads 54 to the printer control board through a flexible cable.

Figure 13:
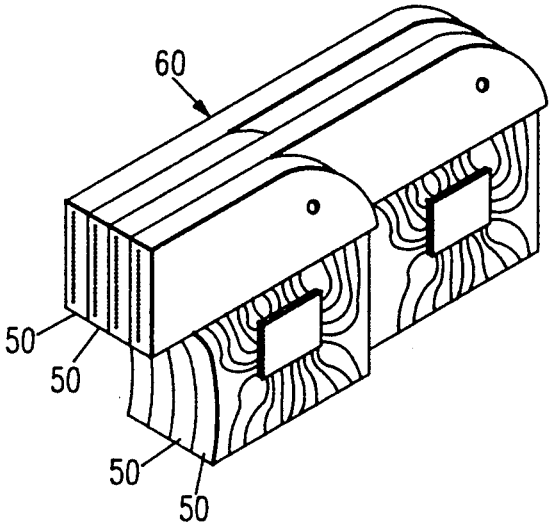
FIG. 13 is another embodiment of the thermal drop-ondemand ink jet print head which is suitable for color printing.
Figure 14:
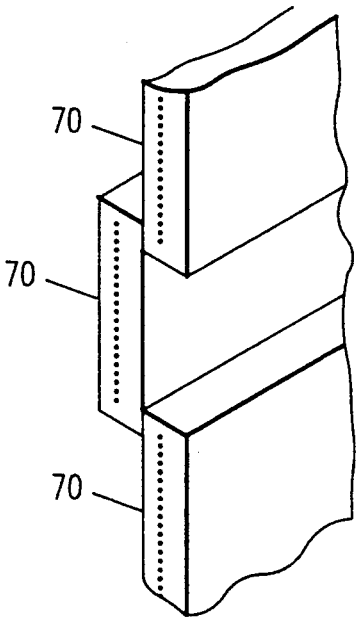
FIG. 14 is yet another embodiment of the thermal drop-on-demand ink jet print head in which modular print heads are stacked to produce a page-wide print head.

The embodiment of the print head shown in FIG. 12 can be utilized in a color print head 60 which is shown in FIG. 13. The color print head 60 comprises four print heads 50 which are mounted side by side. One print head is utilized to print black and the other print heads are utilized to print one of the three primary colors. Alternatively, the print head could be fabricated with one head for printing black and one head for printing color in which the head for printing color has three groups of nozzles and flow channels to provide a primary color to each group of nozzles.

In some cases, it is desired to have a print head which extends across the entire print sheet. However, it may not be possible to manufacture a print head of this size with high yield. In this case, a plurality of modular print heads 70 are mounted in an alternately staggered, stacked arrangement to extend individual print head modules 70 to a page-wide length. In this embodiment, the nozzle at the end of a module is mechanically aligned with the correct spacing to that of the adjacent module. The relative energization time of the thin film resistive heater elements in each of the print head modules 70 is controlled electronically to compensate for the slightly different position of alternate modules so that a straight line of drops can be produced across the entire page.

While the preferred embodiments of the present invention have been illustrated in detail, it should be apparent that modifications and adaptations to those embodiments may occur to one skilled in the art without departing from the scope of the present invention as set forth in the following claims.

Having thus described our invention, what we claim as new and desire to secure by Letters Patent is:

1. A thermal drop-on-demand ink jet print head comprising:

a substrate having two surfaces joined by a common edge;

an array of heater elements formed on said edge;

two sets of thick film conductor elements (12, 14), one on each of said surfaces, those elements of at least one of the sets extending to said edge, each element (12) of one set being discrete and in electrical contact with a corresponding one of the heater elements, and at least one of the electrodes (14) of the other set being in common electrical contact with a plurality of said heater elements, such that the print head may be activated by application of electrical pulses to selectable discrete conductor elements;

each heater element comprising a thin film (15) of resistive material, and thin film conductor electrodes (23, 24) applied to said edge to electrically connect the conductor elements of one set with one area of the resistive material of the respective heater elements and electrically connect another area of the resistive material of the respective heater elements with the conductor electrodes of the other set; and a dielectric passivation layer over said arrays.

2. The print head of claim 1, further comprising:

a nozzle plate comprising a plurality of spaced nozzles and means for fixing each of said nozzles in a position spaced from said edge of said substrate so that a nozzle is positioned opposite each heater element; and a fluid manifold and means to provide a fluid path from said manifold to said space between said nozzle plate and said heater elements, whereby a drop of ink can be ejected from said nozzle each time said heater element is energized with a data pulse applied to a selected one of said conductor electrodes.

3. A thermal drop-on-demand ink jet print head comprising:

a substrate having two surfaces joined by a common edge;

an array of heater elements (15') formed on said edge;

two sets of thick film conductor elements (12, 14'), one on each of said surfaces, those elements of at least one of the sets extending to said edge, each element (12) of one set being discrete and in electrical contact with a corresponding one of the heater elements, and at least one of the electrodes (14') of the other set being in common electrical contact with a plurality of said heater elements; and each heater element (15') comprising a thin film resistive material (26') which overlies and contacts said edge, and conductor electrodes (23', 24') deposited over a portion of said resistive material such that the effective area of each heater element is precisely defined by the unshorted area of such resistance material.

4. The print head of claim 3, further comprising:

a nozzle plate comprising a plurality of spaced nozzles in a first and a second parallel row, and means for fixing said nozzles in a position spaced from said edges of said substrates so that a nozzle is positioned opposite each heater element; and a fluid manifold and means to provide a fluid path from said manifold to said space between said nozzle plate and said heater elements, whereby a drop of ink can be ejected from said nozzle each time said heater element is energized with a data pulse applied to a selected one of said conductor electrodes.

5. A thermal drop-on-demand ink jet print head comprising:

two parallel adjacent substrates, each having two surfaces joined by a common edge;

an array of heater elements formed on each edge;

each substrate having two sets of thick film conductor elements, one on each of said surfaces, each element (12) of one set being discrete and on the nonadjacent surfaces of the substrates and in electrical contact with a corresponding one of the heater elements, and said other set comprising a single common electrode sandwiched between the adjacent surfaces of the substrates and making common electrical contact with a plurality of said heater elements;

means mounting said substrates such that said heater element are disposed in offset staggered relation to each other;

each heater element comprising a thin film (15) of resistive material, and thin film conductor electrodes (23, 24) applied to said edge to electrically connect the conductor elements of one set with one area of the resistive material of the respective heater elements and electrically connect another area of the resistive material of the respective heater elements with the conductor electrodes of the other set; and a dielectric passivation layer over said arrays.

* * * * *